US005517736A

United States Patent [19]

Dalla Vecchia

[11] Patent Number: 5,517,736

[45] Date of Patent: May 21, 1996

[54] TEASELING AND/OR FLUFFING MACHINE FOR FABRIC AND KNITWORK WITH TENSION CONTROL

[75] Inventor: Gino Dalla Vecchia, Santorso, Italy

[73] Assignee: Sperotto Rimar S.p.A., Thiene, Italy

[21] Appl. No.: 291,455

[22] Filed: Aug. 17, 1994

[30] Foreign Application Priority Data

Aug. 30, 1993 [IT] Italy ..... MI93A1862

[51] Int. Cl.[6] ..... D06C 11/00

[52] U.S. Cl. ..... 26/33; 26/34

[58] Field of Search ..... 26/29 R, 31, 32, 26/33, 34, 35, 29 P, 27, 28

[56] References Cited

U.S. PATENT DOCUMENTS

| | | | |
|---|---|---|---|
| 532,940 | 1/1895 | Bauche | 26/33 |
| 720,018 | 2/1903 | Greene | 26/33 |
| 1,154,350 | 9/1915 | Thiel | 26/33 |
| 1,968,963 | 8/1934 | Schiffers | 26/33 |
| 4,897,901 | 2/1990 | Scholaert | 26/33 |

*Primary Examiner*—Amy B. Vanatta
*Attorney, Agent, or Firm*—Cushman Darby & Cushman

[57] ABSTRACT

A teaseling and/or fluffing machine for fabric and knitwork, with tension control, including a load-bearing structure with two sidepieces supporting at least one drum which rotates about a central shaft and supports on its two lateral end-pieces two series of teaseling and/or fluffing rollers, of with-pile type and against-pile-type. These rollers are arranged along generatrices of the drum with those of one series rotating relative to those of the other under independent drive. A fabric to be treated passes about the teaseling and/or fluffing rollers and is fed to the machine by a driven feed roller and extracted therefrom by a driven exit roller. Brushes are provided which interact alternately with the teaseling and/or fluffing rollers. Between the feed roller and the drum and, respectively, between the exit roller and the drum, there are interposed two further rollers, the shafts of which are rotatably supported on automatic tension control devices fixed to the load-bearing structure and controlling respective motors of the feed roller and exit roller, in order to automatically control and regulate the fabric tension, both at its entry and at its exit.

3 Claims, 3 Drawing Sheets

TEASELING AND/OR FLUFFING MACHINE FOR FABRIC AND KNITWORK WITH TENSION CONTROL

BACKGROUND OF THE INVENTION

This invention relates to a teaseling and/or fluffing machine for fabric and knitwork with tension control.

Known teaseling and/or fluffing machines are composed essentially of one or more drums rotating with predetermined direction and speed, along their circumference there being housed a certain number of teaseling and/or fluffing rollers. If the rollers are teaseling rollers they are embraced by cloth carrying needles projecting alternately in the same direction as the fabric (with the pile) and in the opposite direction (against the pile), the rollers rotating about their respective longitudinal axes under independent control. The same applies to fluffing rollers, which carry an abrasive paper covering instead of cloth carrying needles. These rollers also rotate with predeterminable speed and direction.

The fabric to be teaseled and/or fluffed wraps around a considerable part of the drum circumference and part of the teaseling and/or fluffing rollers, the cloth being fed via an entry roller and extracted from the drum via an exit roller. These entry and exit rollers also rotate at predetermined speed, depending on the working or advancement speed of the fabric.

The speed of the two rollers can be different and predetermined in relation to the desired fabric tension.

A constant fabric tension results in a constant teaseling and/or fluffing effect.

If the physical conditions of the fabric change, for example the fabric becomes more or less dry or its selvedges vary, then tension on the fabric changes, and in order to be able to respond to modern requirements, the plant has to be provided with automatic systems which ensure a constant predetermined tension.

SUMMARY OF THE INVENTION

The object of the present invention is to solve the aforesaid problems.

This object is attained according to the present invention by a teaseling and/or fluffing machine for fabric and knitwork with tension control, comprising essentially a load-bearing structure consisting of two sidepieces supporting at least one drum which rotates about a central shaft and supports on its two lateral endpieces two series of teaseling and/or fluffing rollers of with-pile and against-pile t.vpe, these being arranged along the generatrices of said drum with those of one series rotating relative to those of the other under independent drive, a fabric to be treated passing about the teaseling and/or fluffing rollers and being fed to the machine by a driven feed roller and ertracted therefrom by a driven exit roller, there also being provided brushes which interact alternately with the teaseling and/or fluffing rollers, characterised in that between the feed roller and the drum and, respectively, between the exit roller and the drum there are interposed two further rollers the shafts of which are rotatably supported on automatic tension control devices fixed to the load-bearing structure and controlling respective motors of the feed and exit rollers, in order to automatically control and regulate the fabric tension, both at entry and at exit of the fabric. In the case of need, the roller axes can be inclined by a motor controlled bv the automatic tension control devices which automatically regularize the tension of the two fabric selvedges.

BRIEF DESCRIPTION OF THE DRAWINGS

The characteristics and advantages of a teaseling and/or fluffing machine according to the present invention will be more apparent from the ensuing description given by way of non-limiting example with reference to the accompanying schematic drawings, in which.

DETAILED DESCRIPTION

Figure 1:
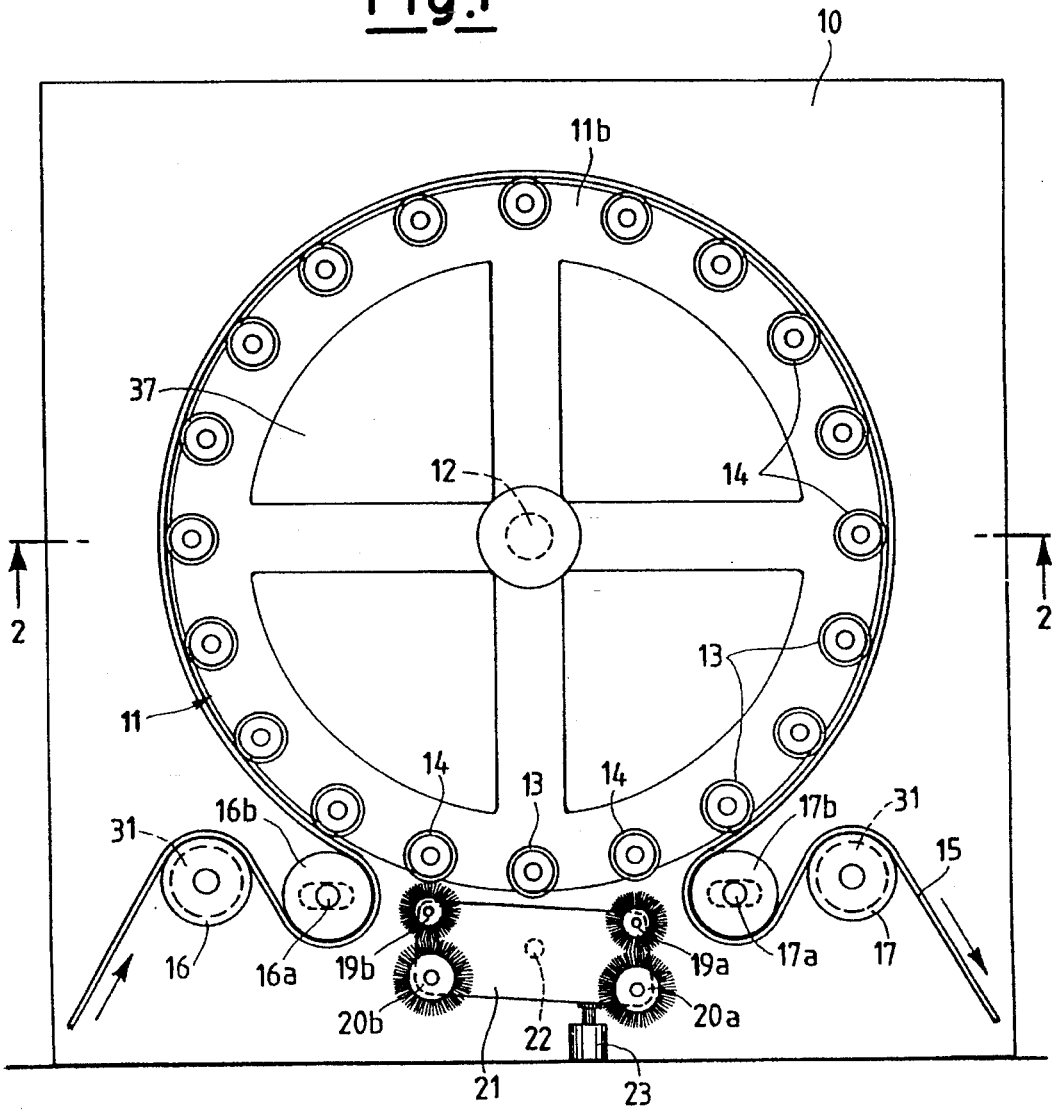
FIG. 1 a cross-section through the teaseling and/or fluffing machine according to the present invention taken on the line 1—1 of FIG. 2.
Figure 2:
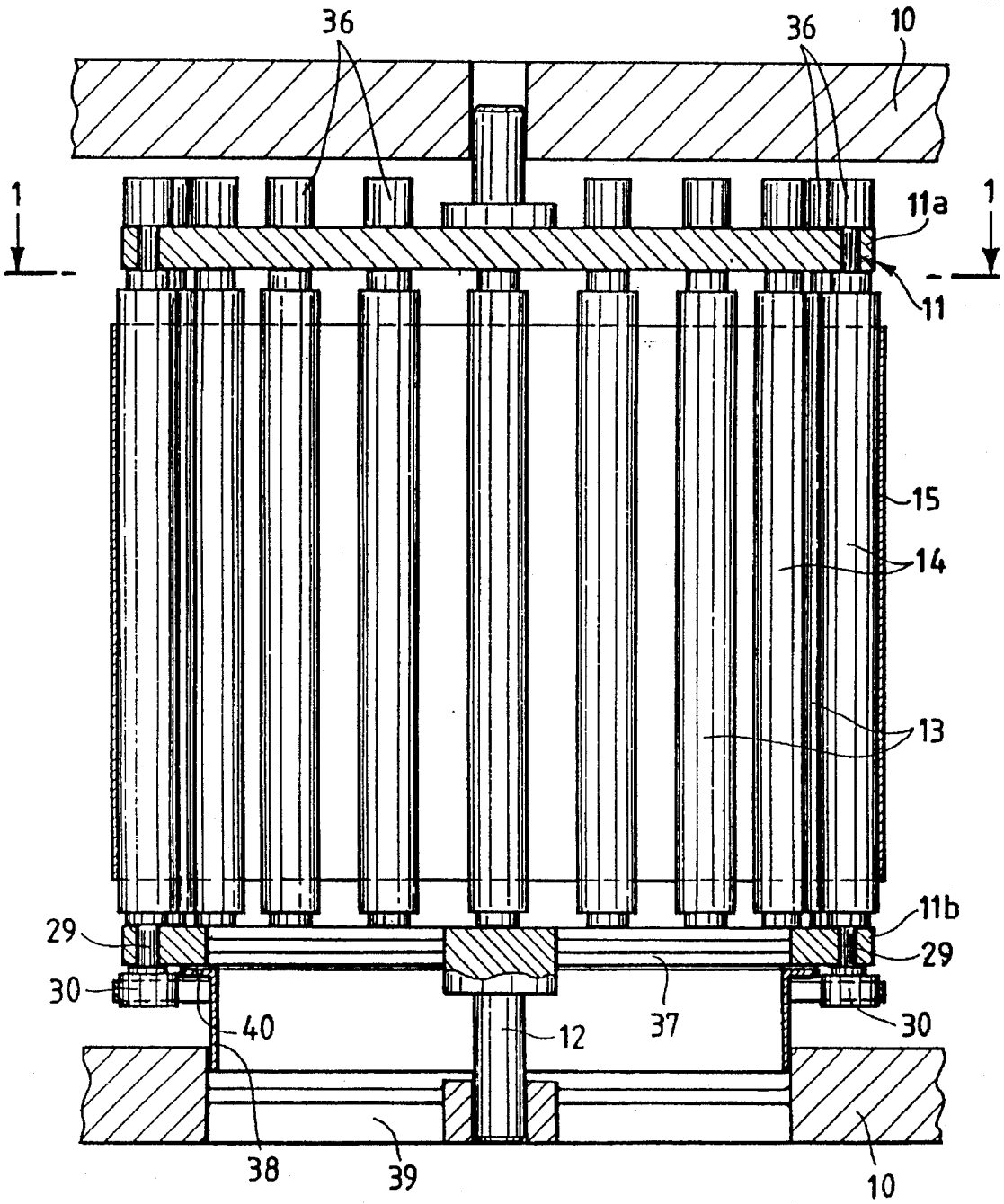
FIG. 2 is a section on the line 2—2 of FIG. 1.

The figures show a teaseling and/or fluffing machine for fabric and knitwork according to the present invention.

The teaseling and/or fluffing machine comprises essentially a load-bearing and containing structure consisting generally of two sidepieces 10, on which there is supported a drum 11 rotating about a central motorized shaft 12. The endpieces 11*a*, 11*b* of the drum 11 support two series of teaseling and/or fluffing rollers, rotating respectively with the pile 13 and against the pile 14, and arranged along generatrices of the drum 11. In addition the rollers 13 and 14, for example, alternate individually with each other and rotate with independent drive and direction relative to one another.

A fabric 15 to be treated passes partially about the drum 11 and over the teaseling and/or fluffing rollers 13 and 14 and is fed by a feed roller 16, but, before passing onto the drum and over the teaseling and/or fluffing rollers 13 and 14 to be extracted by an exit roller 17, it passes about and is controlled by further rollers 16*b* and 17*b*.

The feed roller 16 and exit roller 17 are located in proximity to two groups of teaseling and/or fluffing roller cleaning brushes indicated by 19*a*, 20*a* and 19*b*, 20*b*.

Both the brush groups are made alternately and selectively active, the first group always-on the with-pile teaseling and/or fluffing rollers 13 and the second group always on the against-pile teaseling and/or fluffing rollers 14, via elements which cause them to engage the respective rollers.

Figure 3:
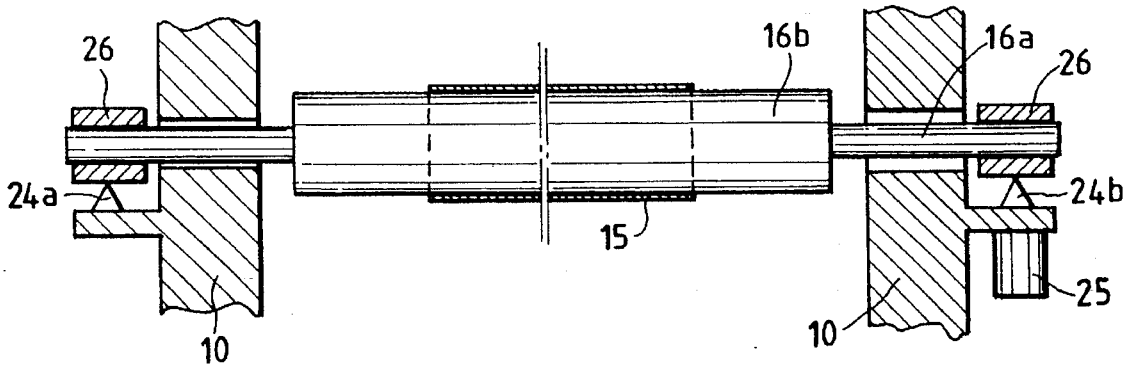
FIG. 3 is an enlarged view of a further feed and/or exit roller provided with fabric tension balancing cells.

It should be noted that the shafts 16*a* and 17*a* of the tension control rollers 16*b* and 17*b* according to the present invention are rotatably arranged on automatic tension control devices, such as electronic load cells indicated schematically at 24*a* and 24*b* in FIG. 3.

The load cells 24*a* and 24*b* are positioned in proximity to the two ends of the shafts 16*a* and 17*a* and fixed to the sidepieces 10 of the load-bearing structure to control the two respective motors 31 rotating the feed roller 16 and exit roller 17 in order to automatically regulate the tension of the fabric both at its entry to and at its exit from the drum.

If operating on fabric obtained from double height looms which when cut in half have different-tension or different-length selvedges, the double load cell enables the tensions to be properly adjusted.

This arrangement, shown for the roller 16*b* in FIG. 3 but also valid for the roller 17*b*, is automatically controlled, for example by a motor 25 interacting with the cells 24*a* and 24*b*, and achieves a balancing of the load on the two cells enabling the tension in the fabric 15 to be equalized over its entire height, even if different selvedges are present.

In this respect, the fabric tension causes the shaft 16*a* or 17*a* to act on the supports 26 of the roller 16*b* or 17*b*, these interacting with the load cells 24*a* and 24*b* to control the motor 25.

Hence, a teaseling and/or fluffing machine according to the invention has the following considerable advantages:

automatic fabric tension adjustment both at the entry to and exit from the drum, achieved by automatic tension control devices such as electronic load cells; and selvedge tension balancing achieved by the combined action of tension control devices such as load cells, which by misaligning or inclining the axis of one roller render the effects constant and homogeneous.

I claim:

1. A machine for teaseling and/or fluffing pile of a fabric being fed to and extracted from the machine, comprising:

a load-bearing structure comprising two side pieces;

at least one drum having a central shaft supported in said side pieces for rotation of the drum about said shaft, said drum having a circumference defined by a succession of generatrices;

said drum having two axially opposite end pieces which support between them two intercalated series of fabric pile-treating rollers for at least one of teaseling and fluffing the pile, said rollers being arranged along respective generatrices of said drum;

one said series of said rollers having a drive driving them for rotation in a first direction which corresponds to a direction of lay of said pile from said fabric, and the other said series of said rollers having a drive driving them for rotation in a second direction which is opposite to said direction of lay of said pile;

a motor-driven feed roller disposed adjacent said drum at a first location;

a motor-driven exit roller disposed adjacent said drum at a second location which is displaced angularly about said circumference of said drum from said first location, so that the fabric can be fed by contact with said feed roller into contact with said rollers of the said series, about a portion of the circumference of the drum and extracted by contact with said exit roller;

a plurality of cleaning brushes supported adjacent said circumference for cleaning engagement with rollers of said one and other series;

a fabric feed tension adjustment roller supported by first support means for engagement with the fabric between the driven feed roll and said drum;

a fabric exit tension adjustment roller supported by second support means for engagement with the fabric between the drum and the driven exit roller;

said first and second support means each comprising a respective automatic tension control device fixed to said load-bearing structure and operatively connected respectively with drive motors of said driven feed roller and said driven exit roller for controlling and regulating tension on said fabric respectively as said fabric enters and exits from interaction with said machine.

2. The machine of claim 1, wherein:

each said automatic tension control device is constituted by a set of two respective electronic load cells respectively arranged for load-sensing engagement with opposite ends of an axial shaft of said fabric feed tension adjustment roller and opposite ends of an axial shaft of said fabric exit tension adjustment roller.

3. The machine of claim 2, wherein:

said opposite ends of said axial shaft of said fabric feed tension adjustment roller and said opposite ends of said axial shaft of said fabric exit tension adjustment roller are supported, respectively by said first and second support means, on respective of said side pieces of said load-bearing structure for movement such as to shorten and lengthen travel path length opposite selvedges of the fabric during interaction of the fabric with the machine; and said automatic tension control devices are respectively connected with said first and second support means for automatically lengthening and shortening said travel path lengths relative to one another for equalizing tension on both selvedges of the fabric during interaction of the fabric with the machine.

* * * * *